US006786329B2

(12) United States Patent
Onishi

(10) Patent No.: US 6,786,329 B2
(45) Date of Patent: Sep. 7, 2004

(54) PACKAGING CONTAINER AND METHOD OF MAKING SAME

(75) Inventor: Shunji Onishi, Kochi (JP)

(73) Assignee: Meisei Sansho Co., Ltd., Kochi (JP)

( * ) Notice: Subject to any disclaimer, the term of this patent is extended or adjusted under 35 U.S.C. 154(b) by 111 days.

(21) Appl. No.: 10/183,634

(22) Filed: Jun. 28, 2002

(65) Prior Publication Data

US 2003/0183540 A1 Oct. 2, 2003

(30) Foreign Application Priority Data

Mar. 28, 2002 (JP) ..... 2002-092191

(51) Int. Cl.[7] ..... B65D 81/22

(52) U.S. Cl. ..... 206/209; 206/210; 206/459.5; 220/259.1

(58) Field of Search ..... 206/205, 209, 206/210, 213.1, 363–370, 438–441, 570–572, 459.5; 220/258.1, 258.2, 259.1, 837, 839, 845

(56) References Cited

U.S. PATENT DOCUMENTS 4,990,345 A * 2/1991 Webb ..... 426/123
6,395,318 B1 * 5/2002 Sumpmann et al. ..... 426/115
6,471,122 B1 * 10/2002 Stewart et al. ..... 229/125.09

FOREIGN PATENT DOCUMENTS

JP 11-268765 10/1999

* cited by examiner

*Primary Examiner*—Jimmy G. Foster
(74) *Attorney, Agent, or Firm*—Crowell & Moring LLP

(57) ABSTRACT

A packaging container comprises a container body an upper part opening of which performs as an exit, a seal lid sealing the exit of the container body, and an outer lid openably and closably covering the container body. A commercial label is adhered to an outer surface of the outer lid. The outer lid is attached to the container body openably and closably through the label. The packaging container can store unused pieces of sterilized cotton with a tight seal after a user peels the seal lid, and allows the user to easily and conveniently take out the pieces.

17 Claims, 9 Drawing Sheets

14
23
22
33a
33
11
13
15
21
19
20
28
26
30
2
12
27
10
29
4
32
3
33
12
2
6
C
5
8
1

32
4
4a
4b
33
35
24
36
36
19
29
29
3
20
24
21
17
2
18
C
C
10
30
30
1
12
8
5
6

21
29
19
20
32
3
4
29
17
2
33
12
10
11
30
6
C
C
8
1

Fig.7A
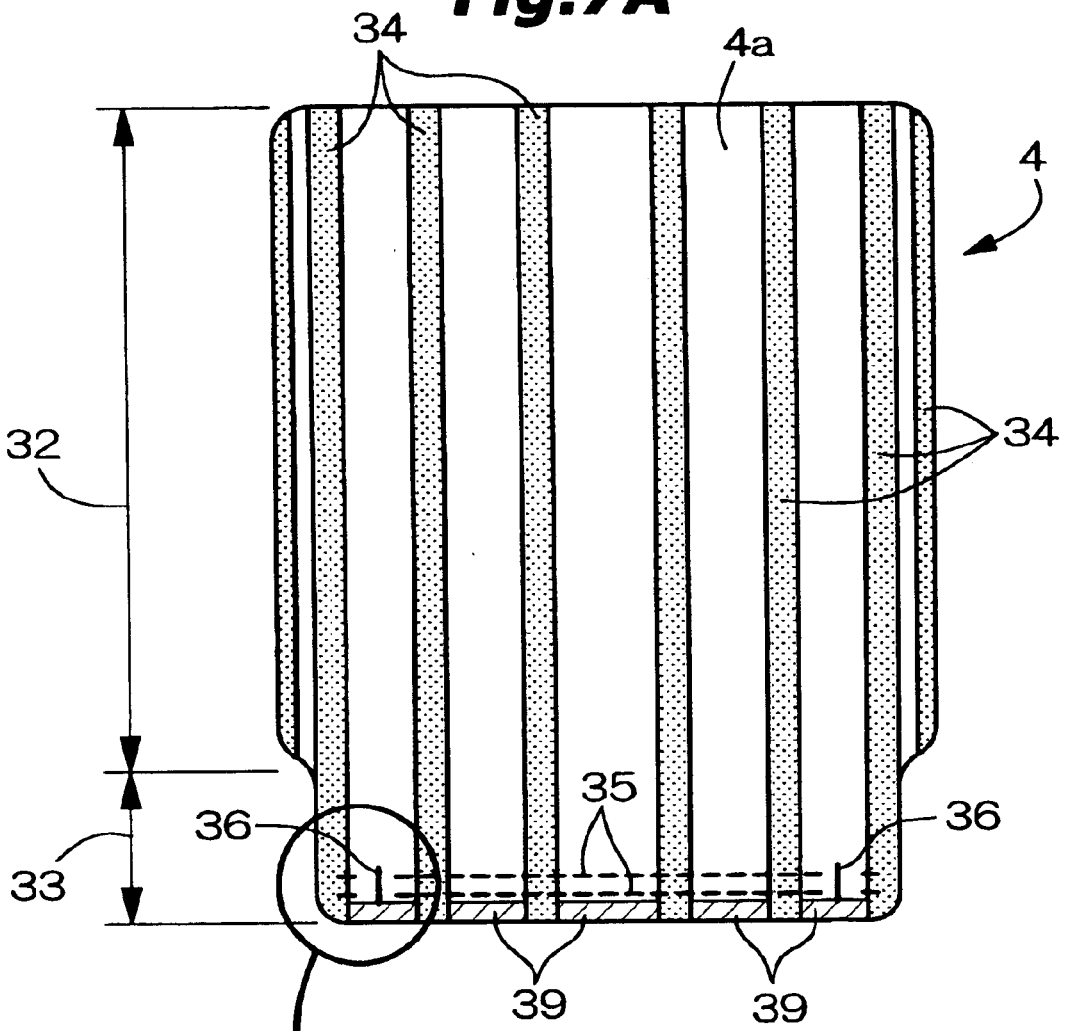
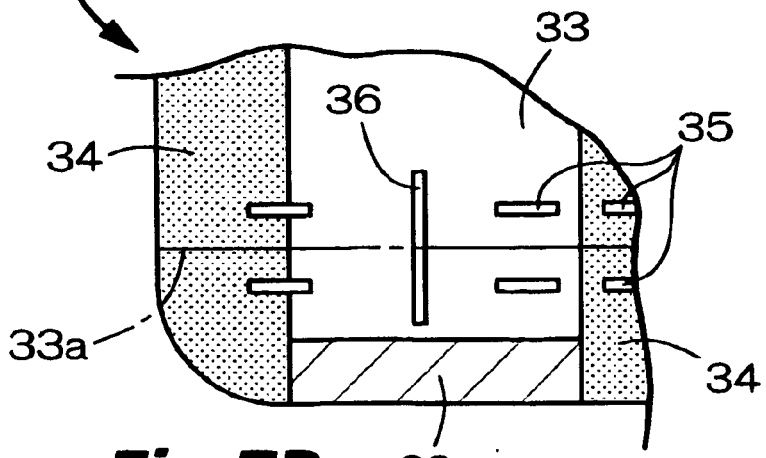
Fig.7B

PACKAGING CONTAINER AND METHOD OF MAKING SAME

BACKGROUND AND SUMMARY OF THE INVENTION

This application claims the priority of Japanese Patent Application No. 2002-92191, filed Mar. 28, 2002, the contents of which are expressly incorporated by reference herein.

This invention relates to a packaging container that can contain multiple pieces of cotton in which liquid disinfectant such as rubbing alcohol is impregnated. A large number of pieces of cotton in which liquid disinfectant such as rubbing alcohol (typically 70% denatured ethyl alcohol or isopropyl alcohol) is impregnated are used during injections in medical care facilities like hospitals. Japanese Patent Application Laid-Open Publication No. 11-268765 (1999) discloses a conventional packaging container which includes a container body for containing pieces of cotton, an inner lid for covering an upper opening of the box body, and an outer lid for opening and closing an aperture provided in the center of the inner lid. The container is shipped with the outer lid adhered with an adhesive to an outer top surface of the inner lid, and sealing the aperture of the inner lid. By peeling the outer lid from the inner lid and thereby exposing the aperture, a user can take out cotton pieces from inside the container. When the container is not in use, the outer lid is closed on the inner lid again, thereby covering the aperture.

In the above-described conventional packaging container, the user repeatedly covers the inner lid with the outer lid, thereby preventing rubbing alcohol impregnated in the pieces of cotton from evaporating and also preventing foreign matter from getting inside the container until all the pieces of cotton in the container are used. However, the aperture is provided in a limited small space of a center part of the inner lid, which makes it difficult for the user to take out the pieces of cotton therethrough. It is especially difficult for a user to take out a piece of cotton when only a few pieces remain in the container.

If the user picks and takes out the piece of cotton with forceps, the piece may be blocked by an edge of the aperture. Further, during the process of taking out the piece, a droplet of rubbing alcohol impregnated in the piece can fall and remain on the inner lid. The remaining alcohol directly contacts the adhesive applied on the outer lid side, thereby decreasing the adhesive power of the inner lid, causing a reduction in the sealing effect of the container. Further, since the container has a construction that has an adhesive coating applied to a reverse side of the outer lid, if the user opens the outer lid in a manner of flipping it over, the adhesive coating is exposed to the outside, which also causes a decrease in adhesive power.

The present invention is directed to overcoming one or more of the problems present in current packaging containers. It is an object of the present invention to provide a packaging container wherein a wide opening of a container body performs as an exit through which pieces of cotton impregnated with liquid disinfectant inside the container body are taken out, thereby allowing a user to easily and smoothly take out the pieces, and wherein the exit is tightly sealed when the container is not in use.

It is a further object of the present invention to provide a packaging container which allows a user to repeatedly and tightly seal an exit even after a user peels a seal lid sealing the exit of the container body.

Still another object of the present invention is to provide a packaging container for giving no deterioration to a sealing effect thereof even if a droplet of liquid falls from a piece of cotton in which liquid disinfectant is impregnated, and remains on a seal lid or an outer lid during a process of taking out the piece from inside of a container body, thereby storing the pieces of cotton inside the container body without dehydrating or degenerating the pieces after a user peels the seal lid.

Yet another object of the present invention is to provide a packaging container with a container body openably and closably attached to an outer lid covering over a seal lid, wherein a commercial label adhered to an outer surface of the outer lid performs as a hinge, thereby lowering the cost of production by the expense of a hinge.

Still another object of the present invention is to provide a packaging container with a commercial label adhered to an outer surface of an outer lid performing as a hinge, that prevents the outer lid covering a container body from opening by itself due to changes in temperature or humidity.

Another object of the present invention is to provide a packaging container with a commercial label adhered to an outer surface of an outer lid performing as a hinge, that prevents a hinge part of the commercial label from damage by repeatedly opening and closing the outer lid.

A further object of the present invention is to provide a packaging container with a commercial label adhered to an outer surface of an outer lid performing as a hinge, wherein a hinge part of the commercial label is tightly adhered to a container body, thereby preventing the hinge part from peeling off the container body even if the hinge part of the commercial label is repeatedly bent during opening and closing actions of the outer lid.

BRIEF DESCRIPTION OF THE DRAWINGS

FIG. 7A illustrates, in a bottom view, a pattern of an adhesive on a commercial label in accordance with the first embodiment of the present invention;

FIG. 7B illustrates, in an enlarged view, a corner of the commercial label of the embodiment illustrated in FIG. 7A;

DETAILED DESCRIPTION OF THE INVENTION

Figures 1A, 1B, 1C:
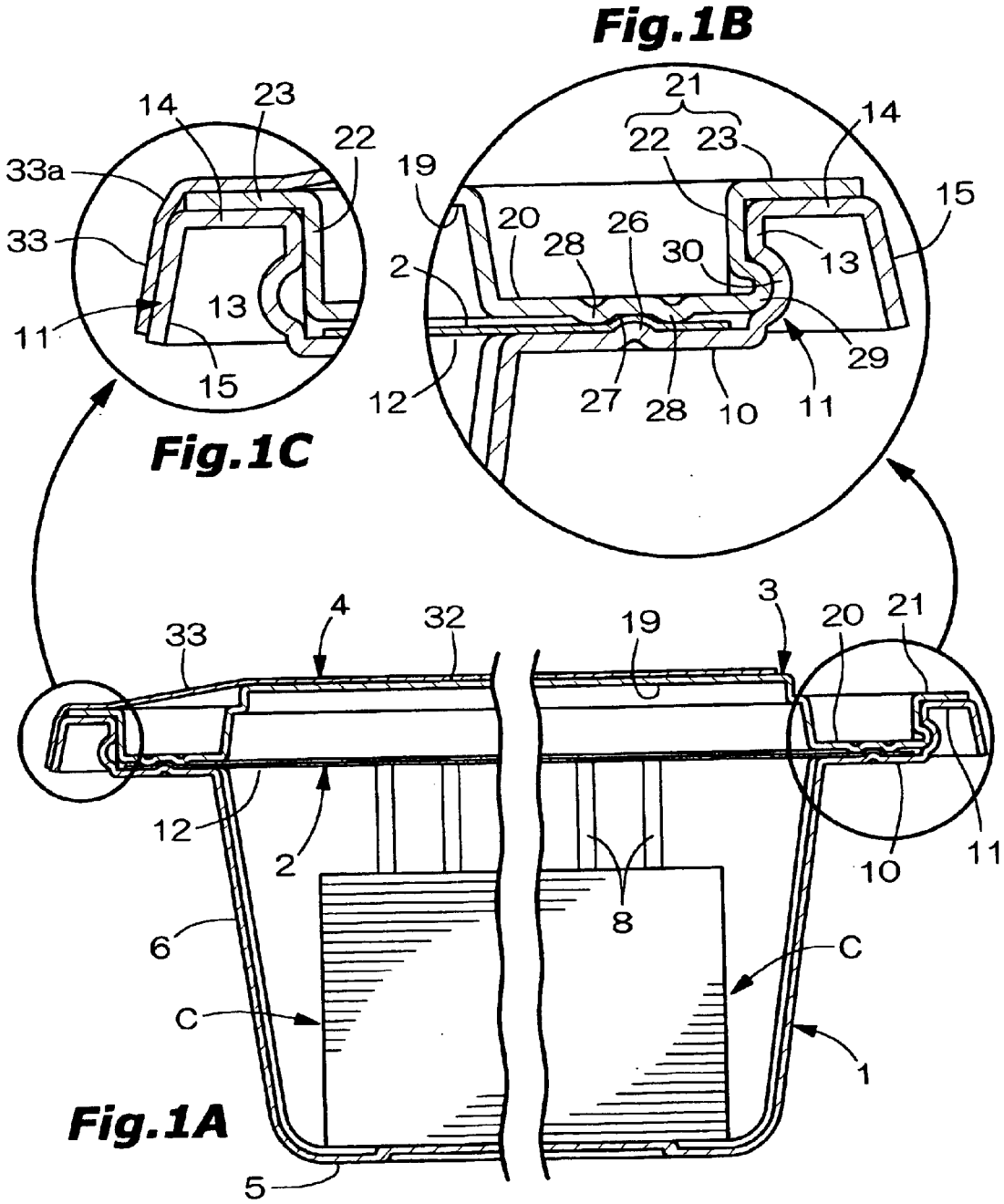
FIG. 1A illustrates, in a side sectional view, a packaging container with an outer lid closed in accordance with a first embodiment of the present invention.
FIG. 1B illustrates, in an enlarged view, a hinge part of the embodiment shown in FIG. 1A.
FIG. 1C illustrates, in an enlarged view, an engaging part of the embodiment shown in FIG. 1A.

In order to achieve the goals of the present invention, as shown in FIGS. 1A, 1B, 1C and 2, a packaging container of the present invention comprises a container body 1 an upper part of which is open as an exit 12, an inner seal lid 2 for sealing the exit 12 of the container body 1, an outer lid 3 for covering over the upper part of an opening of the container 1, and a commercial label 4 adhered to an outer surface of the outer lid 3, so as to contain pieces of cotton C in which liquid disinfectant is impregnated. One example of the material is cotton, one example of the liquid disinfectant is rubbing alcohol, and one example of a shape of the piece is a flat-square shape, but the invention is not limited to these examples.

The container body 1 includes a bottom wall 5, a peripheral sidewall 6 extending upwardly from a periphery of the bottom wall 5, a horizontal flange wall 10 extending outwardly from a top end of the peripheral sidewall 6, and a brim part 11 formed along a periphery of the flange wall 10.

A rim of the seal lid 2 is removably fixed to an upper surface of the flange wall 10. Here, examples of fixing include adhesion with adhesive material or joining material, heat sealing, ultrasonic bonding and so forth.

The outer lid 3 includes a main wall 19 covering over an upper surface of the seal lid 2, a sealing wall 20 continued from the main wall 19, and a border wall 21 formed along a periphery of the sealing wall 20. When the outer lid 3 is closed and attached to the container body 1, the sealing wall 20 catches the rim of the seal lid 2 in the upper surface of the flange wall 10 of the container body 1, and the border wall 21 covers the brim part 11 of the container body 1.

Figure 2:
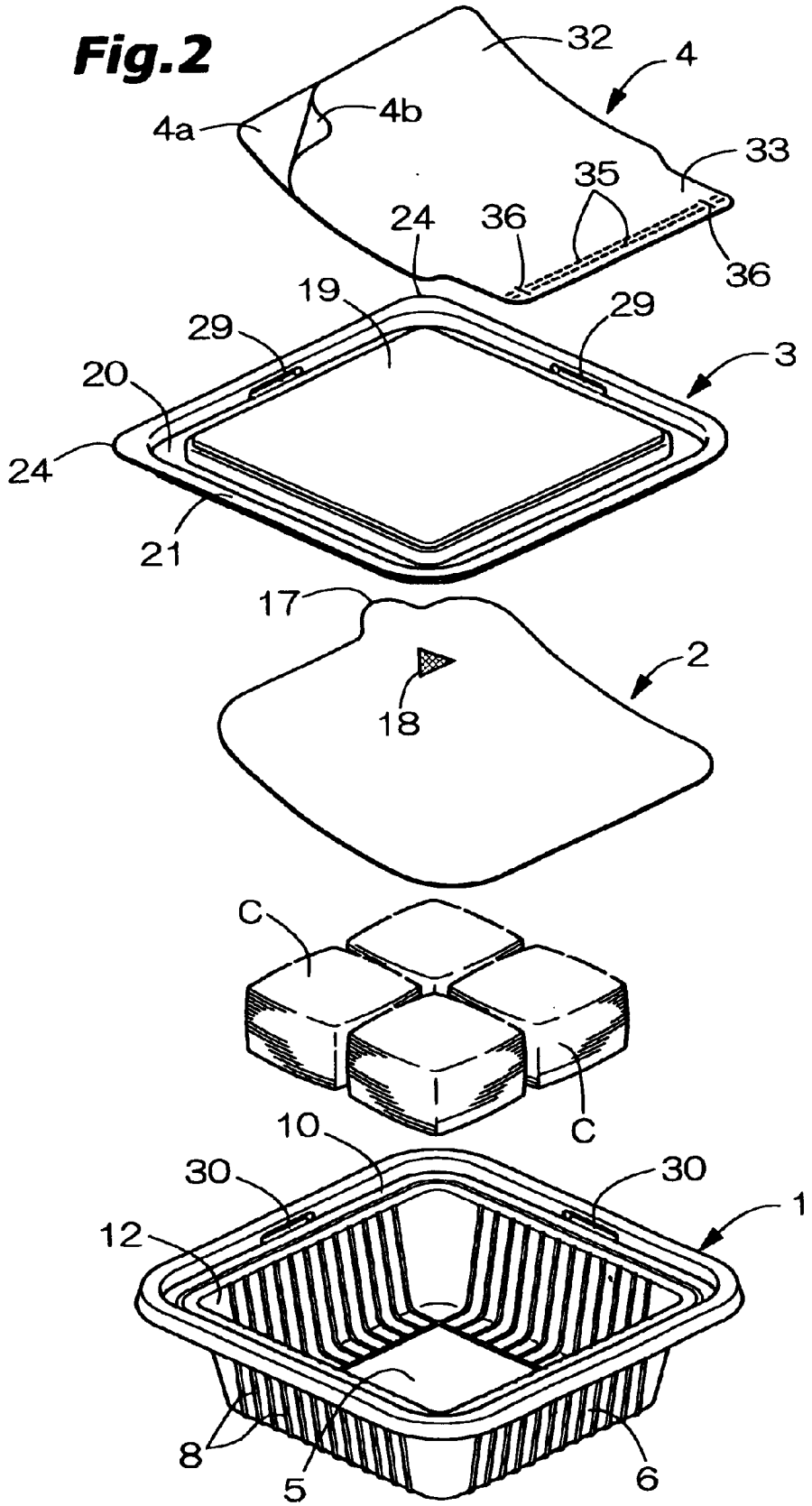
FIG. 2 illustrates, in an exploded perspective view, structural members of the packaging container in accordance with a first embodiment of the present invention.

As shown in FIG. 2, the commercial label 4 includes a main part 32 with optional print, a hinge part 33 led to the main part 32. In this construction, the main part 32 is fixed to an outer surface of the main wall 19 of the outer lid 3, and the hinge part 33 is fixed to the brim part 11 beyond the periphery of the outer lid 3.

As shown in FIGS. 1A and 1B, the flange wall 10 of the container body 1 and the sealing wall 20 of the outer lid 3 respectively include a holding means comprising convex stream 26 and concave stream 27 along the perimeters thereof so as to tightly hold the rim of the seal lid 2 therebetween in a wavy shape in cross section. As shown in the holding means in the figures, while the flange wall 10 is provided with a convex stream 26, the sealing wall 20 is provided with a concave stream 27. The sealing wall 20 is equipped with two convex streams 28 one each on either side of the concave stream 27. Concerning this feature, it is also possible to compose such that the flange wall 10 is provided with the concave stream 27 while the sealing wall 20 is provided with the convex stream 26, or each of the flange wall 10 and the sealing wall 20 are provided with convex streams 26 and 28 such that the convex streams 26 and 28 engage one another.

As shown in FIGS. 1A, 1B, 1C and 2, the brim part 11 of the container body 1 and the border wall 21 of the outer lid 3 are respectively provided with engaging means comprising projection 29 and engaging groove 30, each engaging the other to keep the outer lid 3 closed on the container body 1. Examples of the engaging means include a composition that the brim part 11 of the container body 1 is provided with the engaging groove 30 while the border wall 21 of the outer lid 3 is provided with the projection 29, wherein the projection 29 and the engaging groove 30 engage each other when the outer lid 3 covers the container body 1.

Optionally, the container body 1 and the outer lid 3 are constructed of thin-walled plastic moldings. The outer lid 3 is openably and closably attached to the container body 1 through the commercial label 4. Specifically, the commercial label 4 performs as a hinge for connecting the outer lid 3 openably and closably to the container body 1.

The seal lid 2 can be constructed of a plastic film that serves as a barrier to gas. The rim of the seal lid 2 can be heat-sealed to the top surface of the flange wall 10.

As shown in FIG. 2, the commercial label 4 includes a label base material 4*a* of a plastic film having a heat-sealing property. The label base material 4*a* of the hinge part 33 is heat-sealed to the wall surface of the container body 1.

As shown in FIGS. 7A and 7B, lines of an adhesive 34 are applied to a surface of the label base material 4*a* of the commercial label 4 in a stripe pattern, and the main part 32 of the commercial label 4 is stuck to the outer surface of the main wall 19 of the outer lid 3 with the adhesive 34. Besides, the hinge part 33 of the commercial label 4 is adhered to the wall surface of the container body 1 with the adhesive 34, and the label base material 4*a* exposed between the lines of the adhesive 34 is heat-sealed.

Figure 6B:
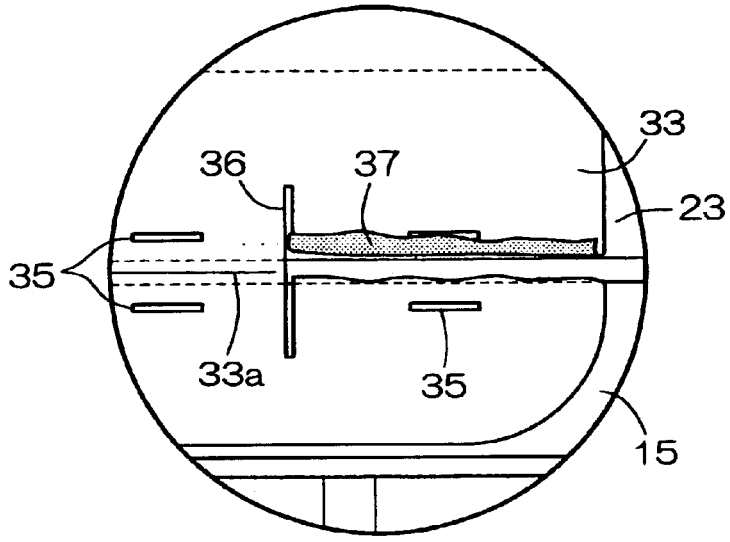
FIG. 6B illustrates, in an enlarged view, a hinge part of the embodiment illustrated in FIG. 6A, wherein a rupture is made.
Figure 6A:
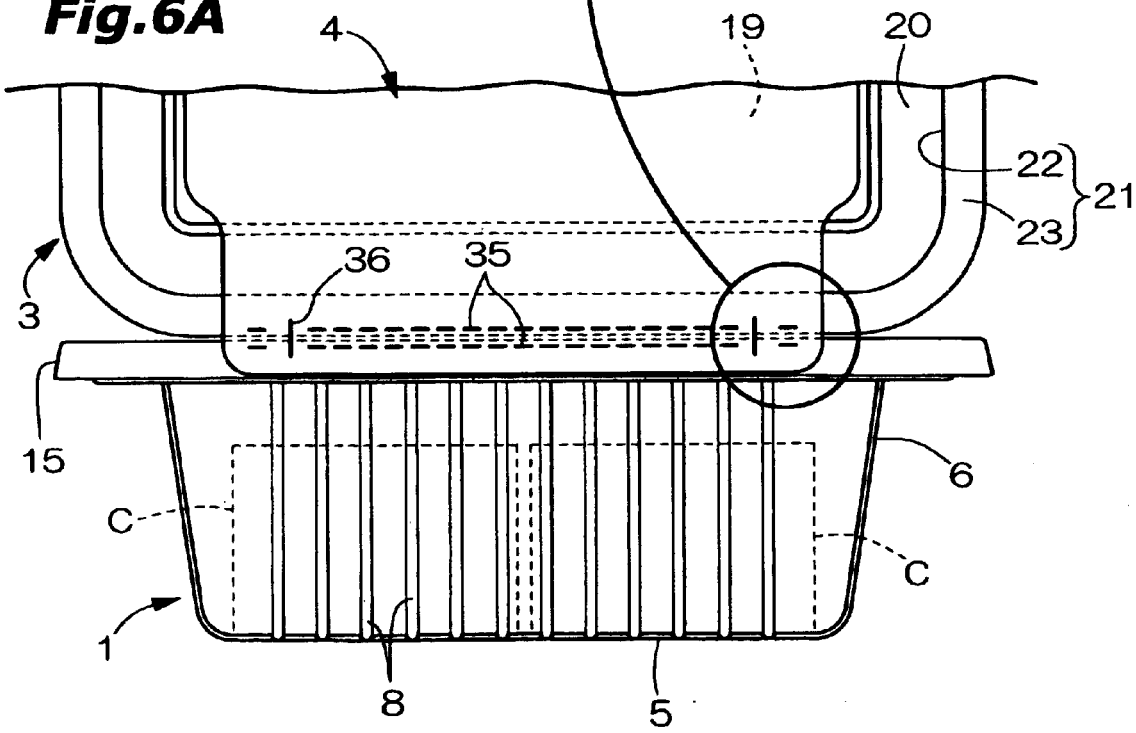
FIG. 6A illustrates, in a rear view, the packaging container with the outer lid closed in accordance with the first embodiment of the present invention.

As shown in FIGS. 6A and 6B, the hinge part 33 of the commercial label 4 has lines of perforations 35, and incisions 36 formed across the lines of the perforations 35 at short distances from both ends of the lines of the perforations 35.

During shipment, the pieces of cotton C are contained in the container body 1, the inside of the container body 1 is completely sealed by the seal lid 2, and the top surface is covered by the outer lid 3. Thus, the outer lid 3 prevents the seal lid 2 from damage caused by contact with foreign matters. In order to take out the piece C, the user opens the outer lid 3 by turning it over around the hinge part 33 of the commercial label 4 as a hinge, and then peels the seal lid 2 from the container body 1. These actions widely expose the exit 12 of the container body 1, which makes it easier to pick the pieces C one by one through the exit 12. Before using up all of the pieces C contained inside the container body 1, the user will again close the seal lid 2 and cover the container body 1 with the outer lid 3.

After production, there elapses quite a long time before the user unseals the seal lid 2. With a view to this point, it is desired that the seal lid 2 tightly seal the exit 12 by heat-sealing the rim of the seal lid 2 to the flange wall 10 of the container body 1. In this case, if the user peels the seal lid 2 once, the rim of the seal lid 2 cannot be adhered to the flange wall 10 again. After peeling the seal lid 2, the user generally uses up all the pieces of cotton C in a short time. In the present invention, the flange wall 10 of the container body 1 and the sealing wall 20 of the outer lid 3 respectively include holding means such as convex stream 26 and concave stream 27. When the user covers the container body 1 with the outer lid 3, the holding means such as convex stream 26 and concave stream 27 tightly hold the rim of the seal lid 2 therebetween with a wavy shape in cross section. This makes it possible to keep the inside of the container body 1 in the tightly-sealed condition.

According to the packaging container of the present invention, when the user opens the seal lid 2, the opening of the container body 1 is widely exposed as the exit 12. Thus, the user can easily take out the pieces of cotton C through the exit 12.

After peeling the seal lid 2 and before taking out another piece of cotton C, the user closes the seal lid 2 to the exit 12, and covers the container body 1 with the outer lid 3. At the time, the outer lid 3 is kept closed by the engaging means 29 and 30 of the lids 1 and 3. Thus, the holding means such as convex stream 26 and concave stream 27 respectively formed in the flange wall 10 of the container body 1 and the sealing wall 20 of the outer lid 3 tightly hold the rim of the seal lid 2 therebetween with a wavy shape in cross section. This makes the sealing function of the container perform effectively, thereby preventing liquid disinfectant impregnated in the pieces C from evaporating, and also preventing outside air from getting inside the container. Therefore, after peeling the seal lid 2, the user can seal the exit 12 repeatedly, and store the pieces C in an optimal condition until using up all of the pieces C.

Since the outer lid 3 and container body 1 hold the seal lid 2 therebetween after peeling the seal lid 2, the sealing effect is not degraded even if a droplet of liquid falls from the piece of cotton C in the process of taking out the piece C. Accordingly, even if the pieces C are stored for a long time after peeling the seal lid 2, the container prevents the pieces C from dehydrating and degenerating.

When the container body 1 and the outer lid 3 are constructed of thin-walled plastic moldings, it is possible to save their weight and produce them in large quantities at a low price. The outer lid 2 is openably and closably attached to the container body 1 through the commercial label 4 which performs as the hinge, so that a hinge itself is unnecessary, thereby simplifying the overall structure, and lowering the cost of production.

When the seal lid 2 is constructed of a gas-impermeable plastic film, the rim of the seal lid 2 can be heat-sealed to the top surface of the flange wall 10. Consequently, the packaging container of the present invention can reliably prevent liquid impregnated in the pieces of cotton C from evaporating even if there is a long time before the seal lid 2 is unsealed after shipment.

Since the label base material 4*a* of the commercial label 4 is made of a plastic film having a heat-sealing property, it is heat-sealed to the wall side of the container body 1. Therefore, even if the hinge part 33 has a small area in the commercial label 4, the hinge part can securely be stuck to the container body 1. This prevents the hinge part 33 of the commercial label 4 from peeling by itself, and the outer lid 3 from separating out of the container body 1 even though the user repeatedly opens and closes the outer lid 3.

Concerning the commercial label 4 of the present invention, lines of the adhesive 34 can be applied to the surface of the label base material 4*a* in a stripe pattern. This can decrease the amount of the adhesive 34 compared to a composition that the adhesive 34 is adhered to the overall surface of the label base material 4*a*, thereby lowering the cost of production. Having a comparatively wide area, the main part 32 of the commercial label 4 can be tightly stuck to the outer surface of the main wall 19 of the outer surface 3. After using up all the pieces, the user can easily remove the commercial label 4 off the outer lid 3, which offers the advantage of fractional recovery of the outer lid 3 and the commercial label 4 for recycling. The hinge part 33 of the commercial label 4 is positioned and adhered to the wall surface of the container body 1 with the adhesive 34 applied in the stripe pattern, then heat-sealed between the lines of the adhesive 34, so that it can tightly be stuck without wrinkles.

Since the commercial label 4 has lines of perforations 35 in the hinge part 33, the user can readily bend the hinge part 33 for opening and closing the outer lid 3 on the container body 1, and avoid partial opening by opening the outer lid 3 to its full width. Especially if the commercial label 4 is made of paper, the label 4 shrinks due to changes in temperature or humidity, and tenses the hinge part 33, so that the outer lid 3 attached to the container body 1 may partially open by itself. Considering this, the hinge part 33 is provided with lines of perforations 35 for absorbing tension in the hinge part 33, and therefore the outer lid 3 does not open from the container body 1 by itself.

If the user repeatedly opens and closes the outer lid 3, the hinge part 33 in the commercial label 4 may become ready to tear along the lines of the perforations 35. In light of this, the hinge part 33 is provided with incisions 36 formed at short distances from both ends of the lines of the perforations 35, so that the incision 36 stops a rupture 37 from extending beyond the incision 36 to the perforation line 35 inside the incision 36, thereby preventing the hinge part 33 from being cut off from the main part 32.

FIGS. 1 through 7 illustrate a packaging container in accordance with the first embodiment of the present invention. The packaging container of the present invention, as shown in FIGS. 1A, 1B, 1C and 2, is provided for containing pieces of sterilized cotton C in which rubbing alcohol is impregnated, and the container is also used as a storage container of the pieces of cotton C after a user brings them in use. When the user uses the packaging container as the storage container, the container prevents rubbing alcohol impregnated in the pieces C from evaporating, and prevents foreign matter from getting inside a container body 1 until the user uses up all of the pieces C. In a preferred embodiment, the container body 1 contains 100 pieces of 4 $cm^2$ cotton.

The packaging container comprises the container body 1 an upper part of which is open, a seal lid 2 for sealing the upper opening of the container body 1, an outer lid for covering over the opening of the container body 1, and a commercial label 4 adhered to an outer surface of the outer lid 3.

The container body 1, such as a thin-walled plastic molding made from translucent polypropylene, includes a square bottom wall 5, and a peripheral sidewall 6 in a square drum like shape which is raised from a periphery of the bottom wall 5 and broadened upward. The peripheral sidewall 6 includes a plurality of longitudinal stiffening ribs 8, in swelling forms, extending from the bottom wall 5.

As shown in FIGS. 1A to 1C, a horizontal flange wall 10 extends outwardly from a peripheral top-edge of the peripheral sidewall 6, and a brim part 11 is formed along a periphery of the flange wall 10. The upper opening enclosed with the peripheral sidewall 6 performs as an exit 12 through which the piece of cotton C is taken out. The seal lid 2 includes a rim which is peelably adhered to the top surface of the flange wall 10, thereby completely closing the exit 12 and sealing the inside of the container body 1.

Figure 4:
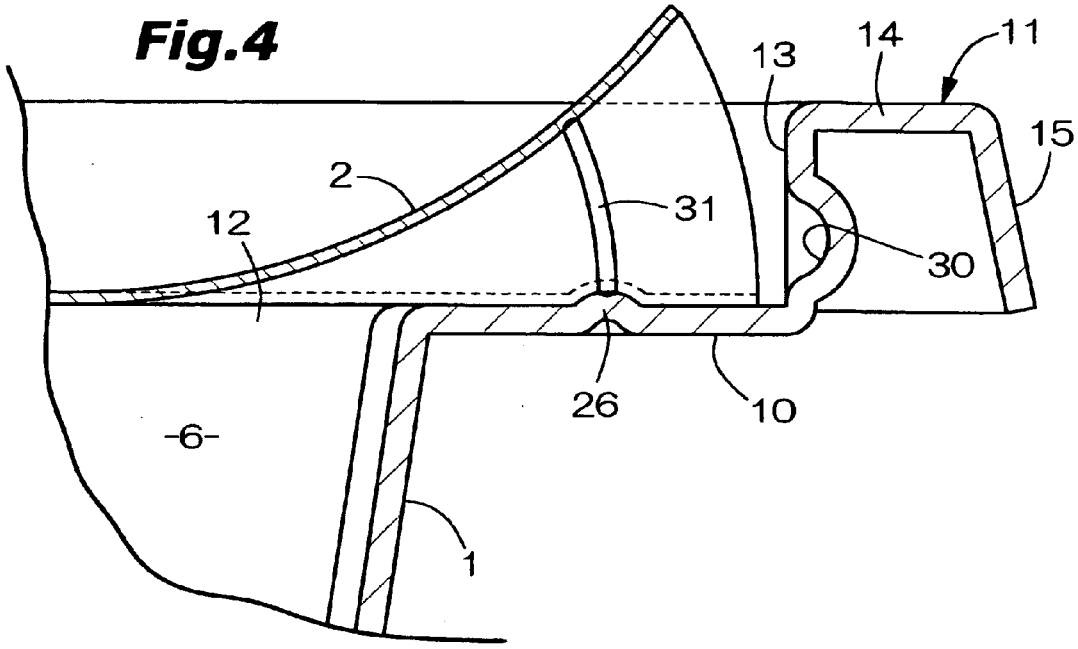
FIG. 4 illustrates, in an enlarged side sectional view, a heat-sealed part of a seal lid in accordance with the first embodiment of the present invention.

As shown in FIG. 4, the brim part 11 comprises an inner sidewall 13 extending upwardly from the peripheral edge of the flange wall 10, a horizontal bearer wall 14 extending outwardly from a top edge of the inner sidewall 13, and an outer sidewall 15 extending downward from a periphery of the bearer wall 14.

The seal lid 2, constructed of a transparent plastic film in a square shape, has the rim heat-sealed to the top surface of the flange wall 10 as further described below. As shown in FIG. 2, the seal lid 2 includes a lobe 17 extending outwardly from the rim facing to a front side of the container body 1. The user can pinch the lobe 17 for peeling the seal lid 2 upwardly. When the user covers the container body 1 with the outer lid 3, the lobe 17 is folded along the brim part 11 of the container body 1, and kept pressed by the outer lid 3. Reference numeral 18 represents a mark printed on the seal lid 2 for suggesting a position of the lobe 17. As a structural material for the seal lid 2, it is preferable to employ a kind of a flexible plastic film having a barrier property to gas, and resistance to alcohol, or a film of plastics composite where multiple kinds of plastic films are layered.

The outer lid 3 comprises a square main wall 19 covering over the exit 12, a sealing wall 20 extending downward from a periphery of the main wall 19 for catching the rim of the seal lid 2 in the upper surface of the flange wall 10, and a border wall 21 formed along a periphery of the sealing wall 20. The outer lid 3 can be constructed of a thin-walled plastic molding of a translucent polypropylene like the container body 1.

Figure 5:
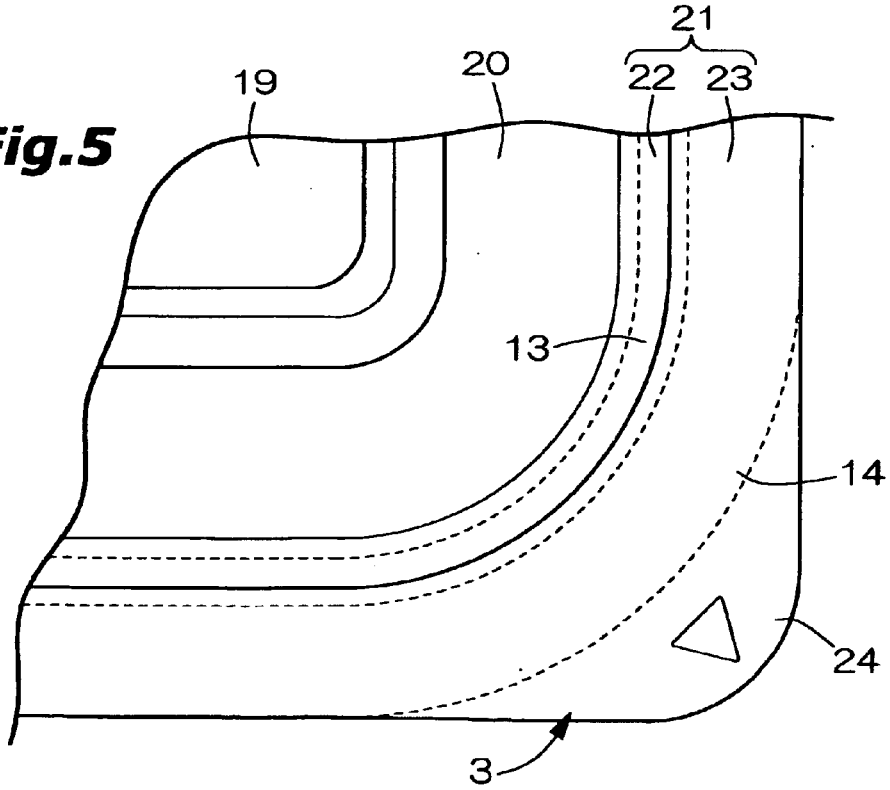
FIG. 5 illustrates, in an enlarged top view, a corner of the outer lid in accordance with the first embodiment of the present invention.

As shown in FIG. 1, the border wall 21 includes a sidewall 22 extending upwardly from a periphery of the sealing wall 20, and a horizontal fringe wall 23 extending outwardly from a periphery of the sidewall 22. As shown in FIG. 5, the fringe wall 23 is provided in its front side with end corners further extending outwardly. The end corners of the fringe wall 23 perform as fingerholds 24.

The user peels off the front, left and right sides, but not the rear side, of the seal lid 2, thereby exposing the exit 12. The seal lid 2 seals the inside of the container body 1 before the user uses up all of the pieces of cotton C in the container body 1 after peeling the seal lid 2. Therefore, the flange wall 10 of the container body 1 and the sealing wall 20 of the outer lid 3 respectively include a convex stream 26 and a concave stream 27 formed along perimeters thereof, such that the convex stream 26 and the concave stream 27 engage with each other for tightly holding the rim of the seal lid 2 therebetween from below and above.

As shown in FIGS. 1B and 2, the convex stream 26 is formed along the perimeter of the upper surface of the flange wall 10, while a pair of convex streams 28 each projecting downward, is formed along the perimeter of the back surface of the sealing wall 20. The concave stream 27 engaging with the convex stream 26 of the flange wall 10 is thereby formed between the convex streams 28. These structures curve the rim of the seal lid 2 into a wavy shape in cross section along three streams 28, 26 and 28, and the wavy shaped part is pressed between surfaces of the flange wall 10 and the sealing wall 20 facing each other. Accordingly, this causes no trouble in the seal lid 2 repeatedly sealing the exit 12 after the seal lid 2 is peeled. As shown in FIG. 4, the seal lid 2 during shipment is heat-sealed along the convex stream 26 of the flange wall 10 along a circumferential line. Reference numeral 31 represents a heat-sealed place.

When the outer lid 3 covers the container body 1, and the seal lid 2 seals the exit 12, the outer lid 3 is desirably kept closed. For this reason, the brim part 11 of the container body 1 and the border wall 21 of the outer lid 3 are respectively provided with engaging means 29 and 30 engaging each other. As shown in FIGS. 1B and 2, an engaging means such as the projection 29 projects outwardly in a rib-like shape and is provided in each of central parts of front, right and left sides in the sidewall 22 of the outer lid 3, while an engaging means such as the engaging groove 30 where the projection 29 engages is provided in each of central parts of all sides in the inner sidewall 13.

The commercial label 4 comprises a main part 32 which is adhered to an outer surface of the main wall 19 of the outer lid 3, and a hinge part 33 which continues from a rear edge of the main part 32. The commercial label 4, as shown in FIG. 2, is a compound sheet which includes a label base material 4*a* made of a plastic film having a heat-sealing property such as polyethylene terephthalete, and a printable layer 4*b* made from paper having a printable property, and laminated in combination on the label base material 4*a*. The printable layer 4*b* in the main part 32 can be printed with a medical specification and effect of the pieces of cotton C, precautions and manufacturer's identification.

As shown in FIG. 7A, multiple lines of an adhesive 34 are applied in a stripe pattern on a backside of the label base material 4*a* of the commercial label 4. The commercial label 4 is adhered to an outer surface of the main wall 19 of the outer lid 3 with the adhesive 34, then, the hinge part 33 shown in FIG. 6B is adhered to the outer surface of the outer sidewall 15 of the container body 1 with the adhesive 34 beyond the rear edge of the fringe wall 23 of the outer lid 3. Further, in the hinge part 33, parts of the label base material 4*a* exposed between the lines of the adhesive 34 are heat-sealed. In FIG. 7A, references 39 represent heat-sealed places.

Owing to the structure described above, the hinge part 33 is firmly fixed to the outer sidewall 15 of the container body 1 by an adhesive effect and a heat-sealing effect. Consequently, the outer lid 3 can be openably and closably attached to the container body 1 by the commercial label 4 as a hinge.

Figure 3:
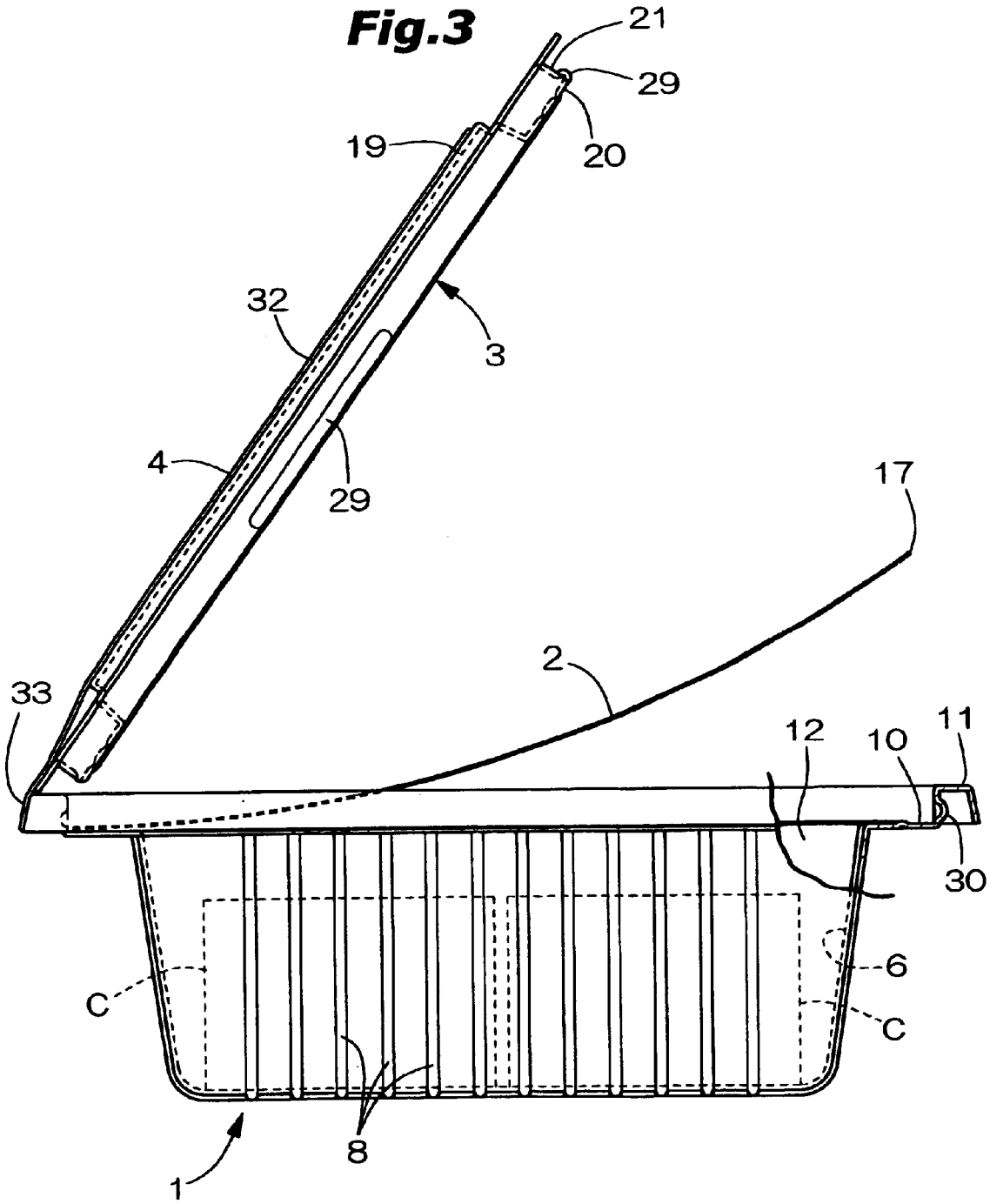
FIG. 3 illustrates, in a partial section side view, the packaging container with an outer lid opened in accordance with the first embodiment of the present invention.

Due to changes in temperature and humidity, especially in dry conditions, the paper printable layer 4*b* is distorted by shrinkage stress, so that the outer lid 3 covering the container body 1 may open by itself. To prevent this, as shown in FIGS. 6A and 6B, the hinge part 33 has straight lines of perforations 35 extending parallel to each other in a right-to-left direction in a joint between the container body 1 and the outer lid 3. Thus, the hinge part 33, as shown in FIG. 3, bends on the outer surface of the outer sidewall 15 of the container body 1, thereby comprising a hinge center 33*a*. The hinge center 33*a* is positioned between the lines of the perforations 35, which makes the outer lid 3 open and close smoothly. The lines of perforations 35 absorb distortion stress of the commercial label 4, and keep the outer lid 3 closed.

If the user repeatedly opens and closes the outer lid 3, the hinge center 33*a* may tear from a side edge thereof. Since the hinge part 33 has the perforations 35, the hinge center 33*a* is ready to tear along the line of the perforations 35. If a rupture 37 reaches the perforation 35, the rupture 37 extends along the line of the perforations 35, which may cut off the hinge part 33. To prevent the rupture 37 from further extending, the hinge part 33 includes incisions 36 formed across the lines of the perforations 35 at short distances from both ends of the lines of perforations 35. Because of this, even if the rupture 37 reaches the incision 36, another rupture will extend from edges of the incisions 36. This prevents the rupture 37 from extending inward from the incision 36 and reaching the perforation 35 inside the incision 36.

As described above, when using the container where the pieces of cotton C are contained, the user flips the outer lid 3 open toward the backside, then pinches the lobe 17 and peels the seal lid 2, thereby exposing the exit 12. At the time, the rear edge of the seal lid 2 is left heat-sealed in order to prevent the seal lid 2 from being displaced when the user again seals the exit 12. After opening the seal lid 2, the user picks and takes out the piece C, optionally by using forceps. In this action, the user can easily and smoothly take out even the last piece C without being blocked by the seal lid 2. If a user expects to use up all of the pieces C, the user will peel the seal lid 2 off, and remove it. Even if a droplet of rubbing alcohol or other material impregnated in the pieces C falls during a process of taking out a piece C, the droplet merely remains on the seal lid 2 or the container body 1, which causes no trouble.

If some of the pieces of cotton C are left unused inside the container body 1, the user will seal the exit 12 with the seal lid 2, then close the outer lid 3. Here, the outer lid 3 is kept closed by the engagement between the projection 29 and the engaging groove 30. Therefore, the seal lid 2 tightly seals the inside of the container body 1. The convex stream 26 and the concave stream 27 provided in the flange wall 10 and the sealing wall 20, respectively, tightly hold the rim of the seal lid 2 therebetween in a shape that appears wavy in cross section. This reliably prevents rubbing alcohol from evaporating out of the piece C, and outside air from getting inside the container. Consequently, after peeling the seal lid 2, the user can repeatedly seal the exit 12.

Figure 8:
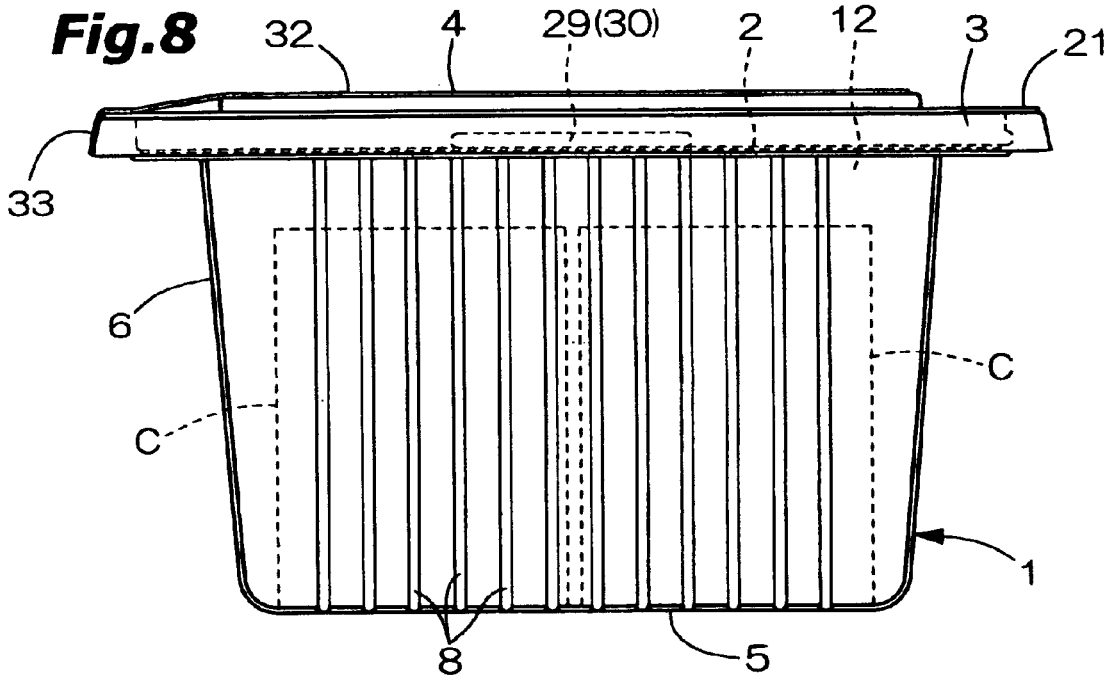
FIG. 8 illustrates, in a side view, a packaging container in accordance with a second embodiment of the present invention.

According to a further embodiment, the size of the container body 1 can be varied in proportion to the number of the pieces of cotton C contained inside the container body 1. For instance, as shown in FIG. 8, a height of the container body 1 can be increased so as to contain larger amounts of material, such as 200 pieces of cotton C.

Figure 9:
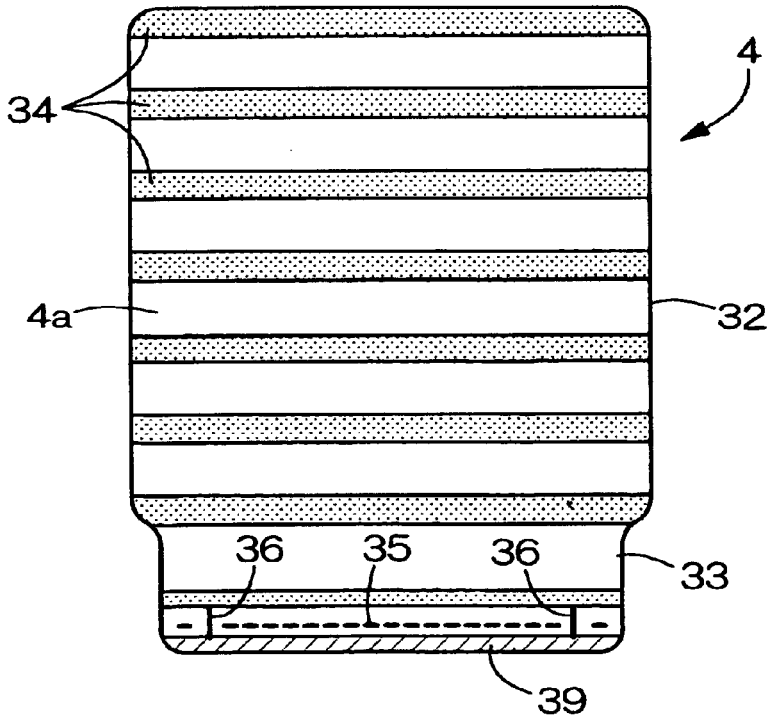
FIG. 9 illustrates, in a bottom view, a commercial label in accordance with a third embodiment of the present invention.

According to further embodiment, as shown in FIG. 9, the adhesive 34 can be applied to the surface of the commercial label 4 in a right-to-left stripe pattern, wherein the hinge part 33 can be heat-sealed along its entire length in a right-to-left direction. It is also possible to form only one line of the perforations 35 as shown in FIG. 9.

Figure 10:
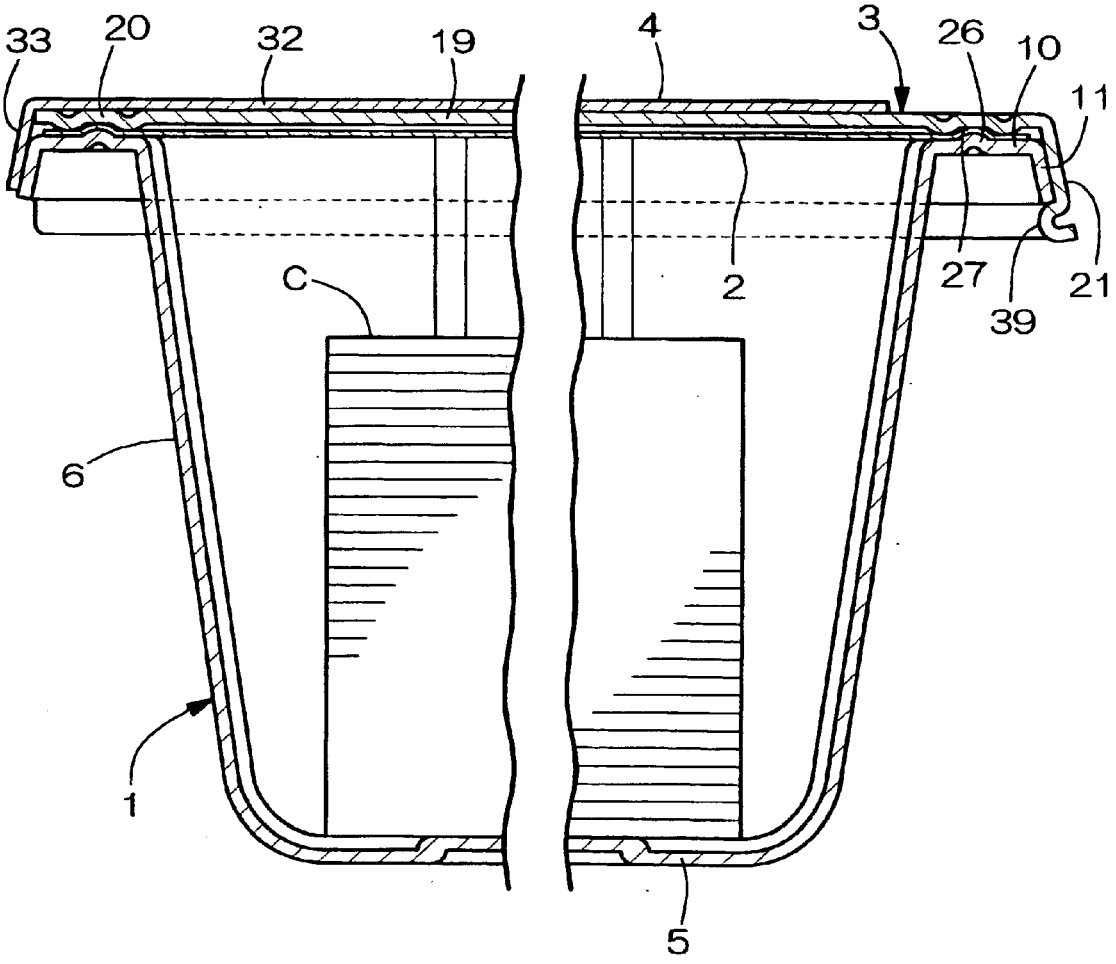
FIG. 10 illustrates, in a side sectional view, a packaging container in accordance with a fourth embodiment of the present invention.

FIG. 10 illustrates a further embodiment of the present invention. In the container body 1 of this embodiment, the brim part 11 extends downward with a slant from the periphery of the flange wall 10. The outer lid 3 includes the main wall 19, the periphery of which performs as the sealing wall 20. Further, the border wall 21 extends downward with a slant from the edges of front, right and left sides of the sealing wall 20. The commercial label 4 has the main part 32 which is adhered to the outer surface of the main wall 19 of the outer lid 3, and the hinge part 33 continuing from the rear edge of the main part 32 is adhered to the outer surface of the rear side in the brim part 11 of the container body 1.

In this further embodiment, when the user covers the container body 1 with the outer lid 3, the engaging part 41 formed along the lower edge of the border wall 21 of the outer lid 3 is locked by the lower edge of the brim part 11, which keeps the outer lid 3 closed. Since other structures are substantially similar to those in the first embodiment, each corresponding element is represented by the same reference numeral, and no explanation is given thereto.

Figure 11:
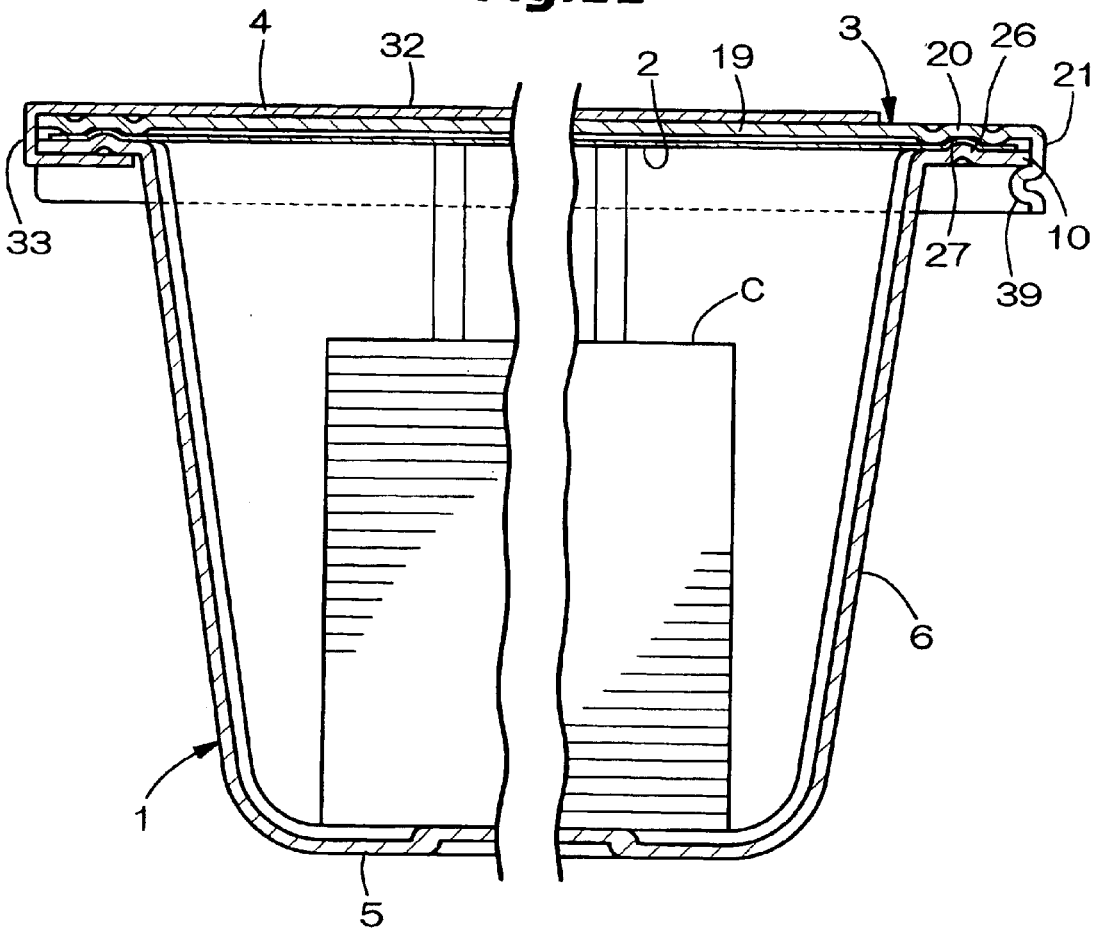
FIG. 11 illustrates, in a side sectional view, a packaging container in accordance with a fifth embodiment of the present invention.

FIG. 11 illustrates a further embodiment of the present invention. The outer lid 3 of this embodiment includes the main wall 19 the periphery of which performs as the sealing wall 20. The border wall 21 extends downward from the edges of front, right and left sides of the sealing wall 20. The commercial label 4 has the main part 32 which is adhered to the outer surface of the main wall 19 of the outer lid 3, and the hinge part 33 continuing from the rear edge of the main part 32 is adhered so as to wrap-around to the lower surface of the rear side in the flange wall 10 of the container body 1.

In accordance with this further embodiment, when the user covers the container body 1 with the outer lid 3, the engaging part 41 formed along the border wall 21 of the outer lid 3 is locked by the periphery of the flange wall 10, which keeps the outer lid 3 closed. Since other structures are substantially similar to those in the first embodiment, each corresponding element is represented by the same reference numeral, and no explanation is given thereto.

Not limited to those embodiments described above, examples of the container contents include sterilized pieces of cotton C impregnated with liquid disinfectant include the pieces in which medical solution such as hydrogen peroxide solution and iodine solution is absorbed, or in which skin lotion or cleansing lotion is absorbed. Further, examples of contents or carriers in which liquid is absorbed include swabs in a ball like shape or any desired shape, sterilized nonwoven material in a square shape, or stick-shaped pieces like cotton buds, the contents are not limited to square, flat pieces of cotton.

In terms of the container body 1, its shape is not limited to square, but any desired shape like circle, oval or polygon can be adopted if required. The lines of perforations 35 can be formed in a zigzag shape. The adhesive 34 on the commercial label 34 can be applied in a pattern which runs with a slant to the front and rear direction.

While the embodiments of the present invention, as herein disclosed, constitute a preferred form, it is to be understood that other forms might be adopted.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A packaging container, comprising:

a container body having an upper part which is open to form an exit, said container body having an inside which contains pieces of cotton impregnated with liquid disinfectant;

an inner seal lid sealing said exit of said container body;

an outer lid covering over said upper part of said container body; and a commercial label adhered to an outer surface of said outer lid, wherein said container body includes a bottom wall, a peripheral sidewall extending upwardly from a periphery of the bottom wall, and a flange wall horizontally extending from a top edge of the peripheral sidewall;

wherein said seal lid includes a rim removably adhered to a top surface of the flange wall;

wherein said outer lid includes a main wall covering over said seal lid, and a sealing wall continued from the main wall and engaging the rim of said seal lid on the upper surface of the flange wall; and wherein said commercial label includes a main part with print adhered to the outer surface of the main wall of said outer lid, and a hinge part continued from the main part and adhered to a wall surface of the container body beyond a periphery of said outer lid.

2. A packaging container according to claim 1, wherein the flange wall of said container body and the sealing wall of the outer lid include holding means formed along a perimeter thereof so as to tightly hold the rim of said seal lid therebetween in a wavy shape in cross section.

3. A packaging container according to claim 1, wherein a brim part formed along a periphery of the flange wall of said container body and a border wall formed along a periphery of the sealing wall of said outer lid are respectively provided with engaging means each engaging one another so as to keep said outer lid closed on the container body.

4. A packaging container according to claim 1, wherein the container body and the outer lid are constructed of thin-walled plastic moldings;

wherein the seal lid is made of a plastic film having a property of a barrier to gas; and wherein the rim of the seal lid is heat-sealed to the top surface of the flange wall.

5. A packaging container according to claim 1, wherein said commercial label further includes a label base material constructed of a plastic film having a heat-sealing property; and wherein the label base material in the hinge part of the commercial label is heat-sealed to the wall surface of the container body.

6. A packaging container according to claim 5, wherein lines of an adhesive are applied to the surface of the label base material of the commercial label in a stripe pattern;

wherein the main part of the commercial label is adhered with the adhesive to the outer surface of the main wall of the outer lid; and wherein the hinge part of the commercial label is adhered with the adhesive to the wall surface of the container body, and portions of the label base material exposed between the lines of the adhesive are heat-sealed.

7. A packaging container according to claim 1, wherein the hinge part of the commercial label has lines of perforations.

8. A packaging container according to claim 7, wherein the hinge part of the commercial label has incisions formed at short distances from both ends of the lines of the perforations.

9. A container, comprising:

a body having an upper part;

an opening in said upper part of said body that forms an exit;

an inner lid removeably attached to said body and configured to cover said opening;

an outer lid configured to cover said upper part of said container body; and a hinge having a first end adhered to an outer surface of said outer lid and a second end adhered to an outer surface of said body;

wherein said body includes a bottom wall, a peripheral sidewall extending upward from a periphery of said bottom wall, and a flange wall extending outward from a top edge of said peripheral sidewall;

wherein said inner lid is adhered to said flange wall; and wherein said outer lid includes a main wall which covers said inner lid, and an engaging wall extending from said outer lid main wall and engaging said inner lid on said flange wall so as to seal said inner lid over said opening when said hinge is in a closed position.

10. A container according to claim 9, wherein said body and said outer lid are comprised of thin-walled plastic and said inner lid is comprised of gas impermeable plastic film.

11. A container according to claim 9, wherein said inner lid is heat-sealed to said flange wall.

12. A container according to claim 9, wherein said hinge is comprised of a first and a second layer, said hinge first layer being an adhesive layer connecting an outer surface of said outer lid and to an outer surface of said body to said hinge second layer, and said hinge second layer comprising at least one line of perforations.

13. A container according to claim 9, further comprising a plurality of cotton balls inside said body.

14. A container according to claim 13, wherein said cotton balls are impregnated with rubbing alcohol.

15. A container comprising:

a body for containing multiple pieces of material;

an opening in an upper part of said body forming an exit;

a covering means for covering said opening; and a sealing means for sealing said covering means onto said opening, wherein an outer surface of said sealing means is flexibly connected to an outer surface of said body so as to form a seal between said covering means and said body when in a closed position, and so as to provide open access to an inside part of said body when in an open position, wherein the flexible connection between said sealing means and said body is formed with an adhesive hinge, and wherein said hinge comprises at least one line of perforation.

16. A method of making a container, comprising:

providing a body having a bottom wall, a peripheral sidewall extending upward from a periphery of said bottom wall, a flange wall extending outward from a top edge of said peripheral sidewall, and an upper part extending inward from a top edge of said peripheral sidewall;

removeably attaching an inner lid to said flange wall of said body;

providing an outer lid configured to cover said upper part of said container body and to seal said inner lid to said container body when said outer lid is in a closed position; and adhering a first end of a hinge to an outer surface of said outer lid and adhering a second end of said hinge to an outer surface of said body, wherein said hinge facilitates opening said outer lid so as to provide access to the inside of said body through said opening.

17. A method of making a container according to claim 16, wherein said hinge is adhered with a heat seal.

* * * * *